US011705293B2

(12) United States Patent
Kato

(10) Patent No.: US 11,705,293 B2
(45) Date of Patent: Jul. 18, 2023

(54) FOOT SWITCH

(71) Applicant: Japan Ergonomics Inc., Saitama (JP)

(72) Inventor: Isamu Kato, Saitama (JP)

(73) Assignee: Japan Ergonomics Inc., Saitama (JP)

( * ) Notice: Subject to any disclaimer, the term of this patent is extended or adjusted under 35 U.S.C. 154(b) by 0 days.

(21) Appl. No.: 17/843,609

(22) Filed: Jun. 17, 2022

(65) Prior Publication Data

US 2022/0406538 A1 Dec. 22, 2022

(30) Foreign Application Priority Data

Jun. 22, 2021 (JP) ..... 2021-103212

(51) Int. Cl.
*H01H 13/16* (2006.01)

(52) U.S. Cl.
CPC ..... *H01H 13/16* (2013.01)

(58) Field of Classification Search
CPC .. H01H 3/00; H01H 3/02; H01H 3/14; H01H 3/16; H01H 3/52; H01H 3/62; H01H 3/70; H01H 9/00; H01H 9/02; H01H 21/00; H01H 21/32; H01H 2003/00; H01H 2003/014; H01H 2021/00; H01H 2021/22; H01H 2221/00; H01H 2221/008; H01H 2231/00; H01H 2231/018; H01H 2300/014
USPC ..... 200/294
See application file for complete search history.

(56) References Cited

U.S. PATENT DOCUMENTS 2,460,494 A * 2/1949 Eisenberg ..... H01C 10/14 338/153
6,452,120 B1 * 9/2002 Chen ..... G05G 1/30 200/86.5

FOREIGN PATENT DOCUMENTS

| | | | |
|---|---|---|---|
| CN | 201708046 | U | 1/2011 |
| CN | 202549638 | U | 11/2012 |
| JP | S38-004439 | Y | 3/1963 |
| JP | H08-249983 | A | 9/1996 |
| JP | 2013-101913 | A | 5/2013 |
| JP | 2014-233600 | A | 12/2014 |

* cited by examiner

*Primary Examiner* — Anthony R Jimenez
(74) *Attorney, Agent, or Firm* — Studebaker & Brackett PC

(57) ABSTRACT

A foot switch includes: a pedal member extending in a front-rear direction; and a base unit connected to the pedal member via a rotating shaft portion. The base unit has: an elastic force applying portion applying an elastic force to the pedal member; a switch portion operated by the pedal member by the pedal member being stepped on and rotating around the rotating shaft portion; and a support portion supporting the pedal member with the elastic force applied from the elastic force applying portion in a state where the pedal member is yet to be stepped on. The elastic force applying portion and the support portion are disposed on one side in the front-rear direction with respect to the rotating shaft portion. The support portion supports a side wall portion of the pedal member.

3 Claims, 6 Drawing Sheets

FOOT SWITCH

CROSS REFERENCE TO RELATED APPLICATIONS

This application claims priority to Japanese Patent Application No. 2021-103212 filed on Jun. 22, 2021, the entire contents of which are incorporated by reference herein.

TECHNICAL FIELD

The present invention relates to a foot switch.

BACKGROUND

In the related art, the foot switch that is illustrated in Japanese Unexamined Patent Publication No. 2014-233600 is known as a foot switch for operating an electronic device by being connected to the electronic device such as a computer. This foot switch includes a pedal member extending in the front-rear direction and a base unit connected to the pedal member via a rotating shaft portion. The base unit includes an elastic force applying portion applying an elastic force to the pedal member and a switch portion operated by the pedal member by the pedal member being stepped on and rotating around the rotating shaft portion.

SUMMARY

Here, in the foot switch, it may be required to shorten the stroke of the elastic force applying portion and increase the elastic force. However, the problem of insufficient pedal member rigidity may arise from an excessive elastic force.

An object of the present invention is to provide a foot switch with which it is possible to suppress a pedal member lacking in rigidity even when the elastic force is increased.

A foot switch according to one embodiment of the present invention includes: a pedal member extending in a front-rear direction; and a base unit connected to the pedal member via a rotating shaft portion. The base unit has: an elastic force applying portion applying an elastic force to the pedal member; a switch portion operated by the pedal member by the pedal member being stepped on and rotating around the rotating shaft portion; and a support portion supporting the pedal member with the elastic force applied from the elastic three applying portion in a state where the pedal member is yet to be stepped on. The elastic force applying portion and the support portion are disposed on one side in the front-rear direction with respect to the rotating shaft portion. The support portion supports a side wall portion of the pedal member.

The foot switch includes the pedal member extending in the front-rear direction and the base unit connected to the pedal member via the rotating shaft portion. The base unit includes the elastic force applying portion applying an elastic force to the pedal member. Accordingly, when a user steps on the pedal member, the pedal member approaches the base unit while rotating around the rotating shaft portion so as to compress the elastic three applying portion. As a result, the pedal member operates the switch portion. Here, the base unit includes the support portion supporting the pedal member with the elastic force applied from the elastic force applying portion in a state where the pedal member is yet to be stepped on. In addition, the elastic force applying portion and the support portion are disposed on one side in the front-rear direction with respect to the rotating shaft portion. The support portion supports the side wall portion of the pedal member. In this case, the support portion is capable of supporting the pedal member with the side wall portion near the elastic force applying portion. Considering a torque balance with regard to the rotating shaft portion, the magnitude of the force that the pedal member receives from the support portion can be suppressed to a magnitude close to the force that the pedal member receives from the elastic force applying portion. Accordingly; considering the three balance in the up-down direction, the magnitude of the force that the pedal member receives from the rotating shaft portion can be suppressed. Accordingly, it is possible to suppress the pedal member lacking in rigidity despite an increase in elastic force.

In the foot switch, the base unit may include: a base member provided with the elastic force applying portion and the switch portion; and a connecting member connected to art end portion of the base member in a width direction. The support portion may have an engaging portion engaging with the side wall portion of the pedal member from an inside in the width direction. The rotating shaft portion and the engaging portion may be provided on the connecting member. In this manner, the rotating shaft portion and the engaging portion are provided on the connecting member, which is a member separate from the base member. Accordingly, by attaching the connecting member to the side wall portion of the pedal member from the inside in the width direction, it is possible to assemble a structure in which the rotating shaft portion is connected to the side wall portion of the pedal member and the side wall portion is engaged by the engaging portion.

The foot switch may include a plurality of switch units including the pedal member and the base unit. The connecting members of the adjacent switch units may be connected to each other via a connecting portion. In this case, the connecting member can be diverted as a member for connecting the adjacent switch units.

In the foot switch, the base unit may have a wall portion on one side in the front-rear direction. The wall portion may have an abutting surface abutting against the pedal member in a state where the pedal member is stepped on. The abutting surface may be inclined such that a distance between the abutting surface and the pedal member increases toward an outside in a width direction. In this case, the inclined part of the abutting surface is capable of accepting the tilting of the pedal member in a case where the pedal member is tilted with respect to the base unit when the pedal member is stepped on by a user. Accordingly, even in a case where the pedal member is depressed in an inclined state, it is possible to suppress the movement of the pedal member being restricted by the abutting surface before the operation of the switch portion.

According to the present invention, it is possible to suppress the pedal member lacking in rigidity despite an increase in elastic force.

DETAILED DESCRIPTION

Figure 1:
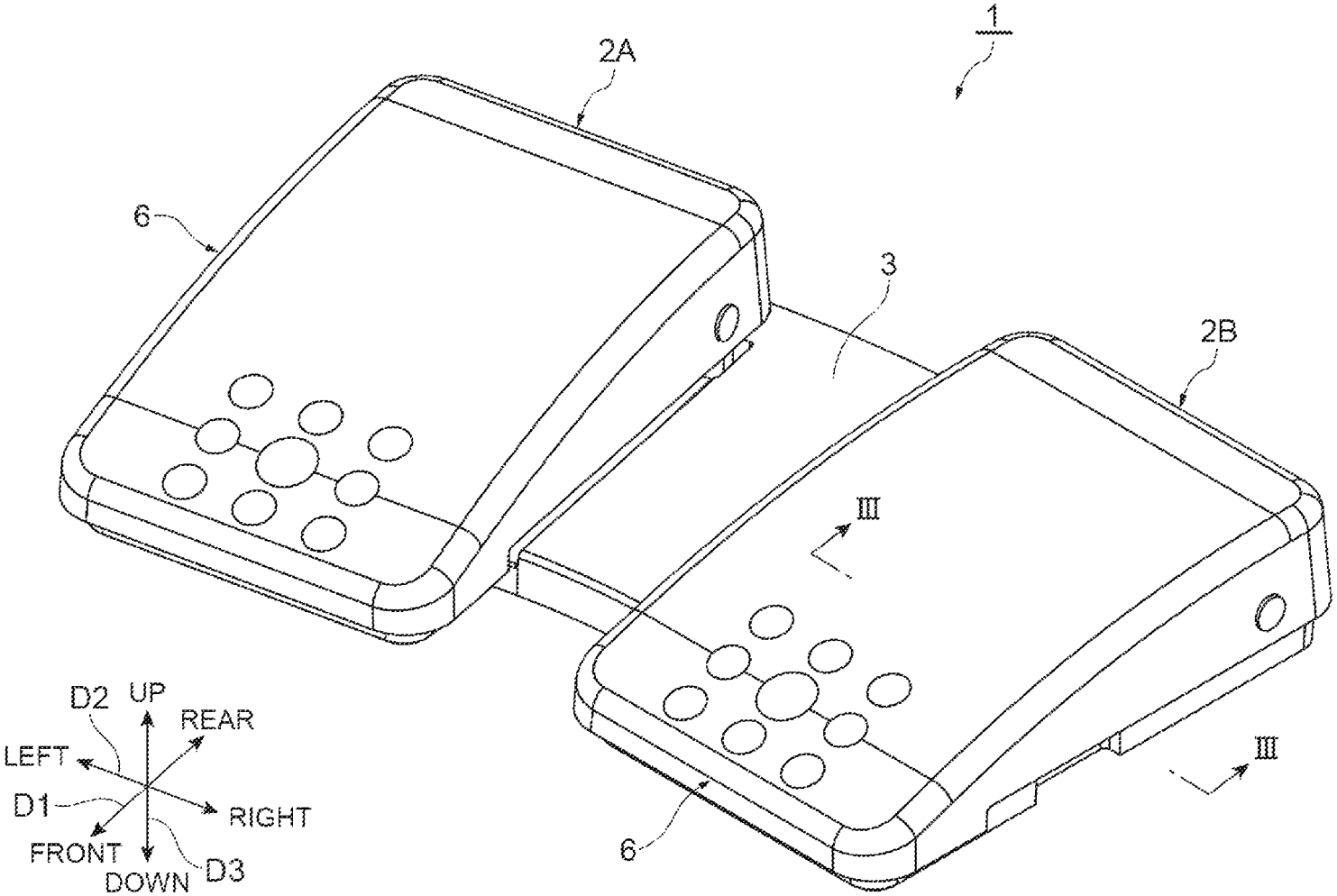
FIG. 1 is a perspective view of a foot switch.

Hereinafter, an embodiment of the present invention will be described with reference to the drawings. In the description of the drawings, the same elements are denoted by the same reference numerals with redundant description omitted.

Figure 2:
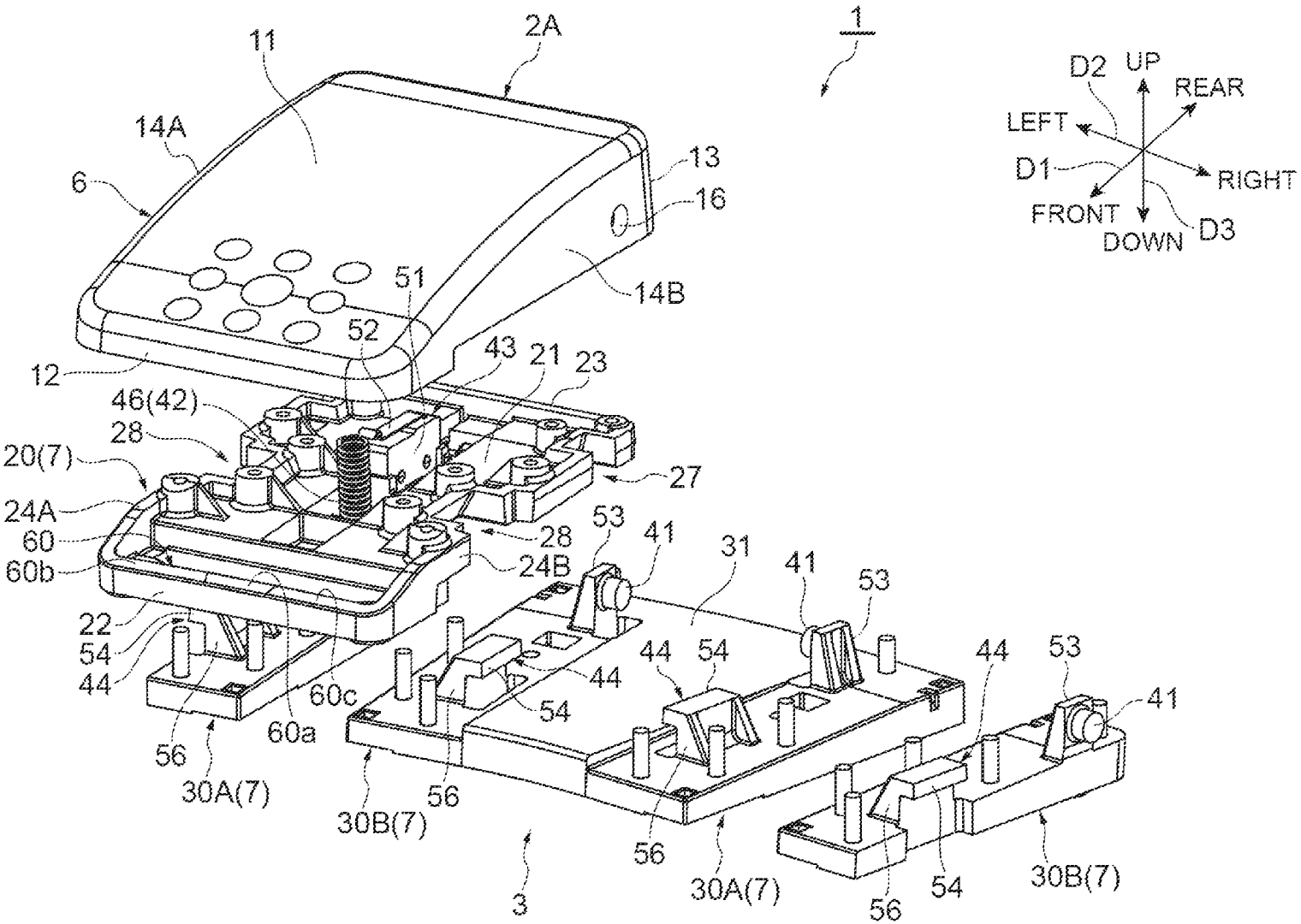
FIG. 2 is a developed perspective view of the foot switch.
Figure 3:
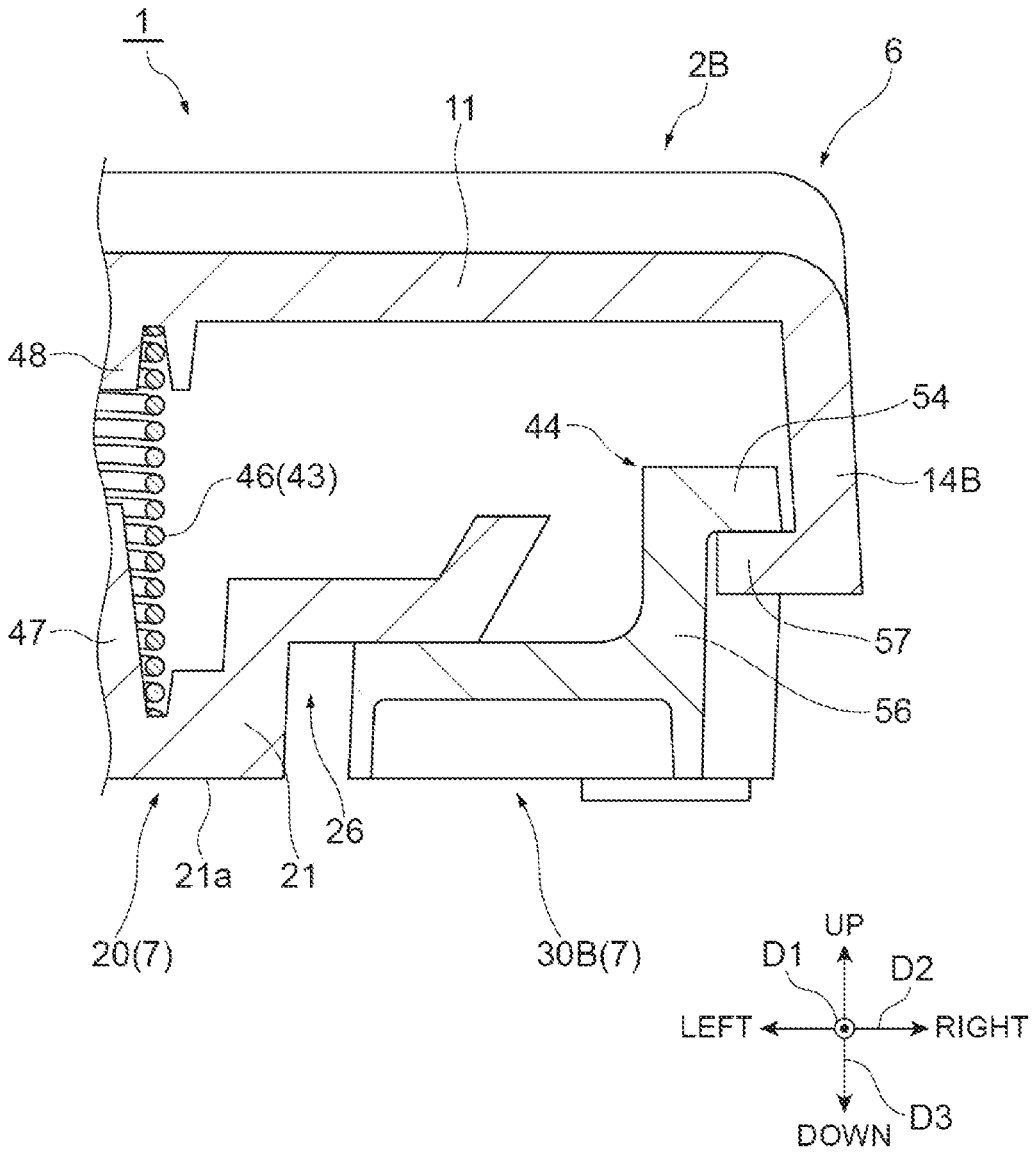
FIG. 3 is a cross-sectional view taken along line III-III of FIG. 1.

A foot switch 1 according to the embodiment of the present invention will be described with reference to FIGS. 1 to 3. FIG. 1 is a perspective view of the foot switch 1. FIG. 2 is a developed perspective view of the foot switch 1. FIG. 3 is a cross-sectional view taken along line III-III of FIG. 1.

The foot switch 1 is a device for operating an electronic device by being connected to the electronic device such as a computer. As illustrated in FIG. 1, the foot switch 1 according to the present embodiment has two switch units 2A and 2B. The switch units 2A and 2B are arranged side by side in a state of being separated from each other in the right-left direction. The switch units 2A and 2B are operation units that can be operated independently of each other. The switch unit 2A is disposed on the left side and the switch unit 2B is disposed on the right side when viewed from a user. The "left" and "right" in the following description are based on the state where the foot switch 1 is viewed from the user. The switch units 2A and 2B are connected by a connector unit 3 in the state of being separated from each other in the right-left direction.

Next, the configuration of the switch unit 2A on the left side will be described with reference to FIGS. 2 and 3. The switch unit 2B on the right side is configured to the same effect as the switch unit 2A on the left side, and thus the switch unit 2B will not be described. In addition, a pedal member 6 and a base member 20 of the switch unit 2B on the right side are not illustrated in FIG. 2, which is to illustrate the states of connecting members 30A and 30B. To describe the switch unit 2A, a front-rear direction D1, a width direction D2, and an up-down direction D3 are set based on the state where the switch unit 2A is viewed from the user. The front side in the front-rear direction D1 that is viewed from the user is "front", and the back side in the front-rear direction D1 that is viewed from the user is "rear". As illustrated in FIG. 2, the switch unit 2A includes the pedal member 6 and a base unit 7.

The pedal member 6 is a member on which the user puts his or her foot and steps on. The pedal member 6 extends in the front-rear direction D1 and widens in the width direction D2. The pedal member 6 includes an upper wall portion 11, a front wall portion 12, a rear wall portion 13, and side wall portions 14A and 14B. The upper wall portion 11 widens in a plate shape in the upper end portion of the pedal member 6. When viewed from the width direction D2, the upper wall portion 11 is curved downward from the rear side to the front side. The upper wall portion 11 widens in the width direction D2 in the curved shape. The front wall portion 12, the rear wall portion 13, and the side wall portions 14A and 14B are wall portions extending downward from the front end portion, the rear end portion, and the left and right end portions of the upper wall portion 11, respectively. Through holes 16 for inserting rotating shaft portions 41 (described later) are formed in the side wall portions 14A and 14B. The through holes 16 are formed near the rear ends of the side wall portions 14A and 14B. In addition, the through holes 16 penetrate the side wall portions 14A and 14B in the width direction D2.

The base unit 7 is connected to the pedal member 6 via the rotating shaft portion 41. The base unit 7 is a unit disposed on an installation surface such as a floor when used. The base unit 7 includes the base member 20 and the connecting members 30A and 30B.

The base member 20 is a member disposed on the lower side of the pedal member 6 in a state of facing the pedal member 6 in the up-down direction D3. The base member 20 is covered from above by the pedal member 6. The base member 20 is a member in which various components of the switch unit 2A are provided. The base member 20 extends in the front-rear direction D1 and widens in the width direction D2. The base member 20 includes a main body portion 21, a front wall portion 22, a rear wall portion 23, and side wall portions 24A and 24B. The main body portion 21 widens in the front-rear direction D1 and the width direction D2. The front wall portion 22, the rear wall portion 23, and the side wall portions 24A and 24B are wall portions extending upward from the front end portion, the rear end portion, and the left and right end portions of the main body portion 21, respectively. The front wall portion 22 of the base member 20 is disposed so as to face the front wall portion 12 of the pedal member 6 from the rear side. The rear wall portion 23 of the base member 20 is disposed so as to face the rear wall portion 13 of the pedal member 6 from the front side. The side wall portions 24A and 24B of the base member 20 are disposed so as to face the side wall portions 14A and 14B of the pedal member 6 from the inside in the width direction D2.

The connecting members 30A and 30B are members connected to the end portions of the base member 20 in the width direction D2. The connecting member 30A is connected to the left end portion of the base member 20. The connecting member 30B is connected to the right end portion of the base member 20. In addition, the connecting members 30A and 30B are provided on the bottom surface side of the base member 20. Specifically, as illustrated in FIG. 3, a step portion 26, which is lifted upward, is formed on a bottom surface 21*a* of the main body portion 21 of the base member 20. The connecting member 30B is disposed in a state of crawling into the step portion 26 of the base member 20. Although a cross section near the right end portion of the base member 20 is illustrated in FIG. 3, the step portion 26 is also provided near the left end portion and the connecting member 30A is disposed in a state of crawling into the step portion 26.

Returning to FIG. 2, the connecting member 30B that is on the right side with respect to the (left) switch unit 2A and the connecting member 30A that is on the left side with respect to the (right) switch unit 2B are connected via a connecting portion 31 extending in the width direction D2. As a result, the connector unit 3 connecting the switch unit 2A and the switch unit 2B is formed by the connecting members 30A and 30B and the connecting portion 31. On the other hand, the connecting member 30A that is on the left side with respect to the (left) switch unit 2A is not provided with the connecting portion 31, and the connecting member 30A is configured as a single member. The connecting member 30B that is on the right side with respect to the (right) switch unit 2B is not provided with the connecting portion 31, and the connecting member 30B is configured as a single member. The single connecting members 30A and 30B are disposed in both end portions of the foot switch 1 in the width direction D2.

The base unit 7 includes the rotating shaft portions 41, an elastic force applying portion 42, a switch portion 43, and support portions 44.

The rotating shaft portion 41 rotatably supports the pedal member 6. One of the pedal members 6 is supported by the pair of rotating shaft portions 41. The left rotating shaft portion 41 is provided on a protruding portion 53 extending upward from the left connecting member 30A. The left rotating shaft portion 41 extends to the left side from the protruding portion 53 of the connecting member 30A and is inserted into the through hole 16 of the left side wall portion 14A. The right rotating shaft portion 41 is provided on the protruding portion 53 extending upward from the right connecting member 30B. The right rotating shaft portion 41 extends to the right side from the protruding portion 53 of the connecting member 30B and is inserted into the through hole 16 of the right side wall portion 14B. Recessed portions 27 for passing the protruding portions 53 are formed in the side wall portions 24A and 24B of the base member 20.

The elastic force applying portion 42 applies an elastic force to the pedal member 6. The elastic force applying portion 42 is configured by a spring 46 disposed between the upper wall portion 11 of the pedal member 6 and the main body portion 21 of the base member 20. The elastic force applying portion 42 is disposed at a substantially middle position of the main body portion 21 in the width direction D2. The elastic force applying portion 42 is disposed on the front side in the front-rear direction D1 with respect to the rotating shaft portion 41. As illustrated in FIG. 3, the lower end portion of the spring 46 is supported by inserting a protruding portion 47 extending upward from the main body portion 21. The upper end portion of the spring 46 is supported by inserting a protruding portion 48 extending downward from the upper wall portion 11.

As illustrated in FIG. 2, the switch portion 43 is operated by the pedal member 6 by the pedal member 6 being stepped on and rotating around the rotating shaft portion 41. The switch portion 43 is disposed on the rear side of the elastic force applying portion 42 of the main body portion 21 and at the middle position of the main body portion 21 in the width direction D2. The switch portion 43 includes a switch body 51 fixed to the main body portion 21 and a lever 52 provided on the switch body 51. When the pedal member 6 is stepped on, the lever 52 is pushed by the upper wall portion 11 and the switch of the switch portion 43 is operated as a result.

In a state where the pedal member 6 is yet to be stepped on, the support portion 44 supports the pedal member 6 with the elastic force applied from the elastic force applying portion 42 to the pedal member 6. The pedal member 6 is supported by the pair of support portions 44. The left support portion 44 is provided on the left connecting member 30A, and the right support portion 44 is provided on the right connecting member 30B. The left and right support portions 44 have engaging portions 54 engaging with the side wall portions 14A and 14B of the pedal member 6 from the inside in the width direction D2. The engaging portion 54 of the left support portion 44 is provided on a protruding portion 56 extending upward from the left connecting member 30A. The engaging portion 54 on the left side extends to the left side from the protruding portion 56 of the connecting member 30A and supports the side wall portion 14A on the left side. The engaging portion 54 of the right support portion 44 is provided on the protruding portion 56 extending upward from the right connecting member 30B. The engaging portion 54 on the right side extends to the right side from the protruding portion 56 of the connecting member 30B and supports the side wall portion 14B on the right side. Recessed portions 28 for passing the protruding portions 56 are formed in the side wall portions 24A and 24B of the base member 20. As illustrated in FIG. 3, a claw portion 57 extending to the left side is formed at the position of the lower end portion of the side wall portion 14B of the pedal member 6 that corresponds to the support portion 44. The support portion 44 engages with the side wall portion 14B from the inside in the width direction D2 by coming into contact with the claw portion 57 from the upper side in the engaging portion 54. The claw portion 57 to the same effect is also formed on the left side wall portion 14A.

As illustrated in FIG. 2, the elastic force applying portion 42 and the support portion 44 are disposed on the front side in the front-rear direction D1 with respect to the rotating shaft portion 41. The elastic force applying portion 42 and the support portion 44 are disposed at substantially the same position in the front-rear direction D1. In other words, the distance of the elastic force applying portion 42 from the rotating shaft portion 41 in the front-rear direction D1 is substantially equal to the distance of the support portion 44 from the rotating shaft portion 41 in the front-rear direction D1.

The base member 20 of the base unit 7 has the front wall portion 22 on the front side in the front-rear direction D1. The front wall portion 22 has an abutting surface 60 abutting against the pedal member 6 in a state where the pedal member 6 is stepped on. The abutting surface 60 is inclined such that the distance between the abutting surface 60 and the pedal member 6 increases toward the outside in the width direction D2. The abutting surface 60 includes a top portion 60*a* and inclined portions 60*b* and 60*c*. The top portion 60*a* extends parallel to the width direction D2 at the middle position in the width direction D2. The inclined portion 60*b* is disposed in the left area with respect to the top portion 60*a* and inclined so as to be lowered toward the left side (see also FIG. 4A). The inclined portion 60*c* is disposed in the right area with respect to the top portion 60*a* and inclined so as to be lowered toward the right side (see also FIG. 4A).

Next, the action and effect of the foot switch 1 according to the present embodiment will be described.

The foot switch 1 includes the pedal member 6 extending in the front-rear direction D1 and the base unit 7 connected to the pedal member 6 via the rotating shaft portion 41. The base unit 7 includes the elastic force applying portion 42 applying an elastic force to the pedal member 6. Accordingly, when a user steps on the pedal member 6, the pedal member 6 approaches the base unit 7 while rotating around the rotating shaft portion 41 so as to compress the elastic force applying portion 42. As a result, the pedal member 6 operates the switch portion 43. Here, the base unit 7 includes the support portion 44 supporting the pedal member 6 with the elastic force applied from the elastic force applying portion 42 in a state where the pedal member 6 is yet to be stepped on. In addition, the elastic force applying portion 42 and the support portion 44 are disposed on the front side (one side) in the front-rear direction D1 with respect to the rotating shaft portion 41. In this case, the support portion 44 is capable of supporting the pedal member 6 with the side wall portions 14A and 14B near the elastic force applying portion 42. Considering a torque balance with regard to the rotating shaft portion 41, the magnitude of the force that the pedal member 6 receives from the support portion 44 can be suppressed to a magnitude close to the force that the pedal member 6 receives from the elastic force applying portion 42. Accordingly, considering the force balance in the up-down direction D3, the magnitude of the force that the pedal member 6 receives from the rotating shaft portion 41 can be suppressed. Accordingly, it is possible to suppress the pedal member 6 lacking in rigidity even when the elastic force is increased.

Figure 5:
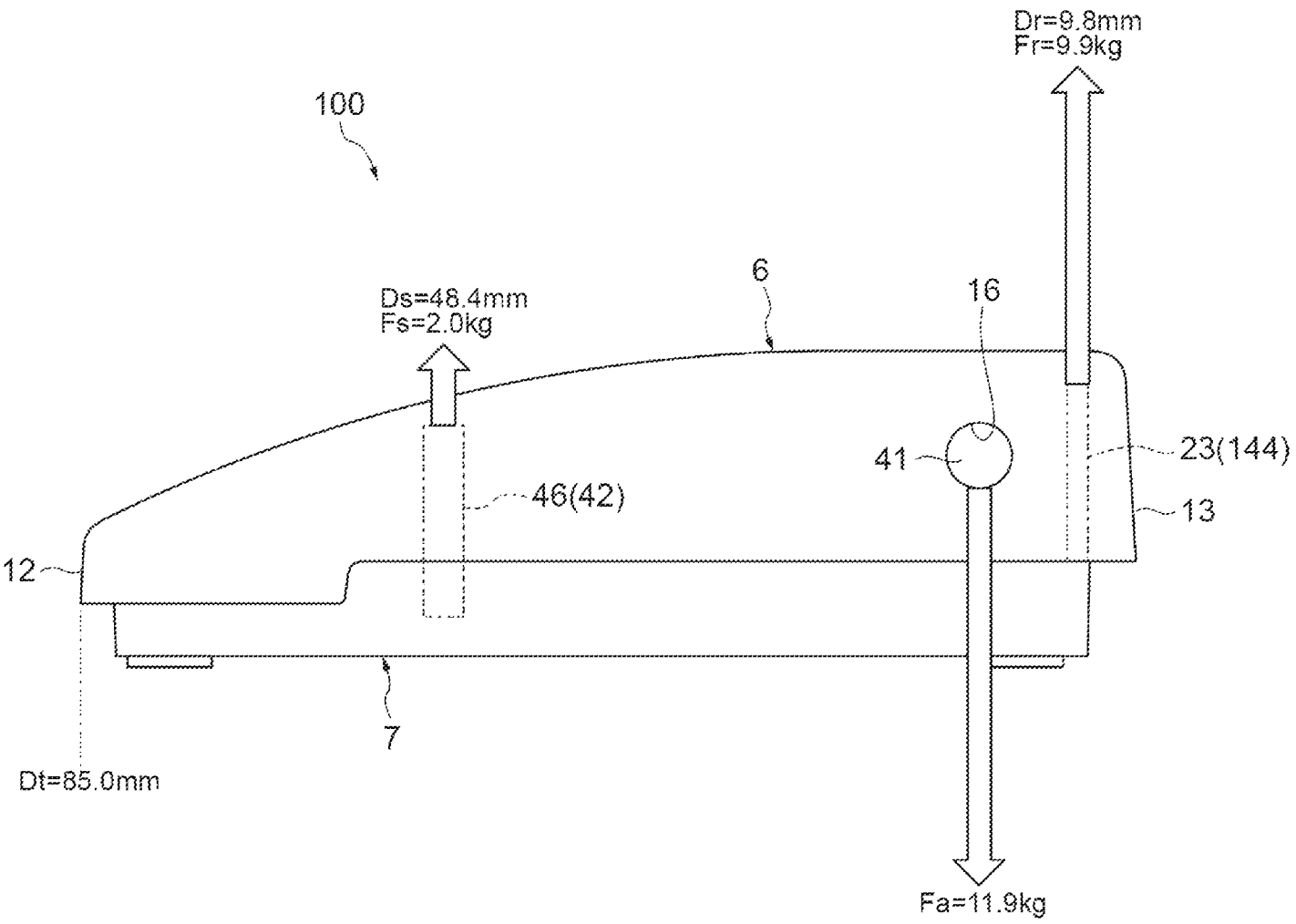
FIG. 5 is a side view of a foot switch according to a comparative example.
Figure 6:
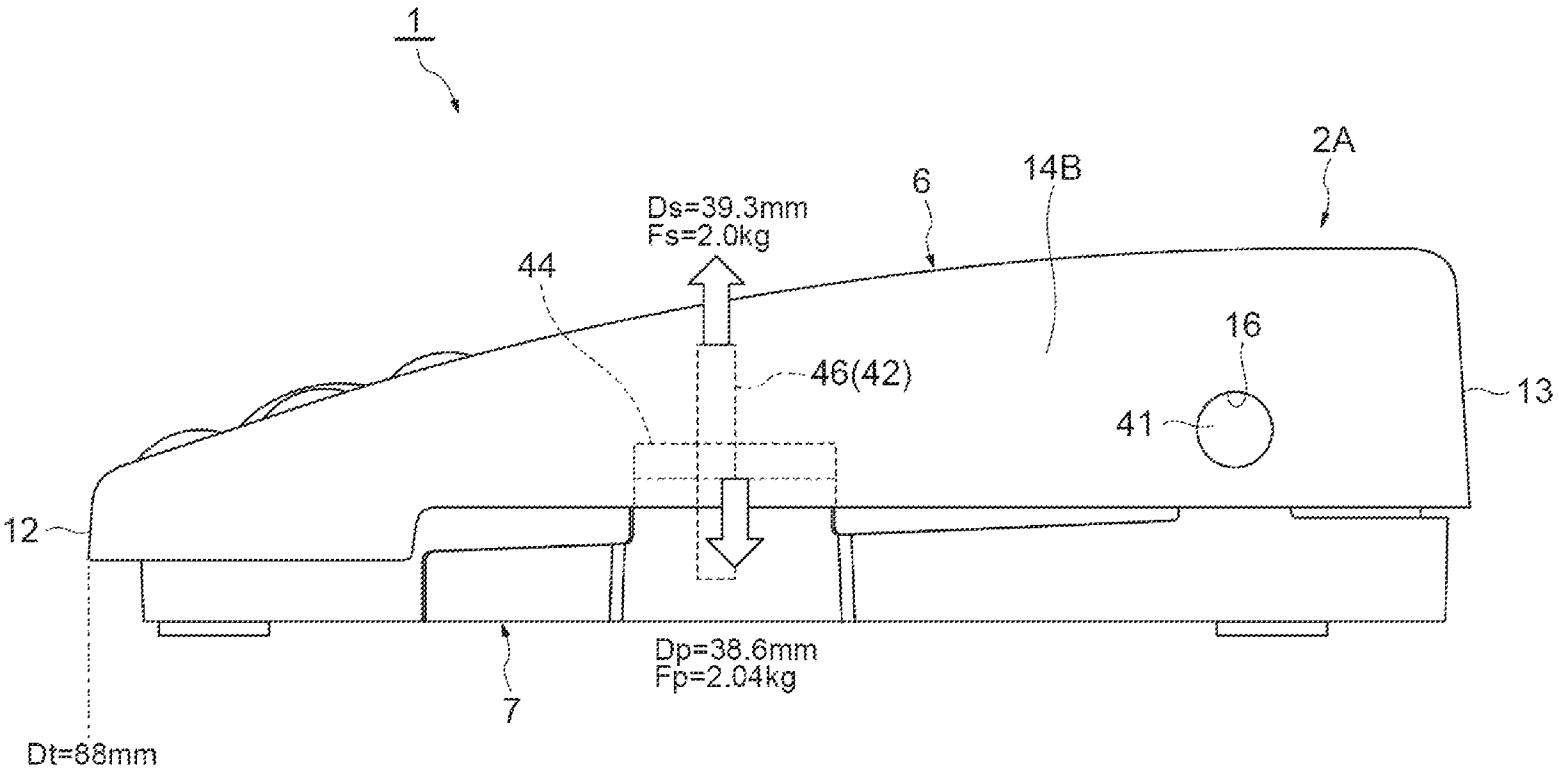
FIG. 6 is a side view of the foot switch according to the embodiment.

The above effect will be specifically described with reference to FIGS. 5 and 6. FIG. 5 is a side view of a foot switch 100 according to a comparative example. FIG. 6 is a side view of the foot switch according to the embodiment. FIGS. 5 and 6 illustrate the balance relationship of forces around the rotating shaft portion 41.

The foot switch 100 according to the comparative example illustrated in FIG. 5 does not have the support portion 44 unlike the foot switch 1 according to the present embodiment. In addition, the foot switch 100 is different from the foot switch 1 in that the rear wall portion 23 of the base unit 7 functions as a support portion 144. The force balance of the pedal member 6 at a time when the pedal member 6 is not stepped on by a user will be described. First, it is assumed that the distance from the rotating shaft portion 41 to the spring 46 of the elastic force applying portion 42 is "Ds=48.4 mm". It is assumed that the force by which the pedal member 6 is pushed upward from the spring 46 is "Fs=2.0 kg". It is assumed that the distance from the rotating shaft portion 41 to the rear wall portion 23 is "Dr=9.8 mm". Assuming that the force by which the pedal member 6 is pushed upward from the rear wall portion 23 is "Fr" in this case, Equation (1) is established from the balance of the torque around the rotating shaft portion 41. Equation (2) is established as a result, and thus the result of "Fr=9.9 kg" can be obtained by value substitution into Equation (2). In addition, assuming that the downward force applied from the rotating shaft portion 41 to the through hole 16 of the pedal member 6 is "Fa", Equation (3) is established from the force balance in the up-down direction, and thus the result of "Fa=11.9 kg" can be obtained by value substitution into Equation (3).

$$Fs \times Ds = Fr \times Dr \quad (1)$$

$$Fr = (Fs \times Ds)/Dr \quad (2)$$

$$Fa = Fs + Fr \quad (3)$$

As described above, it is understood that the forces that act on the pedal member 6 from the rear wall portion 23 and the rotating shaft portion 41 increase in the foot switch 100 according to the comparative example. Such forces act between components, and thus the forces that act on other components also increase, which may lead to the destruction of various components in the foot switch 100. In addition, a decrease in product service life and a change in component shape over time arise as problems.

Here, in the foot switch 100, an increase in the forces acting on components may be suppressed by reducing the force of the spring 46. However, when the force of the spring 46 is small, the problem arises that a signal is output from the foot switch 100 even with a user's foot slightly touching the pedal member 6. In the general foot switch 100, no signal is output unless the pedal member 6 is depressed to some extent such that no signal is output as a result of a slight touch. However, in such a configuration, the stroke from depression initiation to switch pressing becomes long. In this configuration, the problem arises that no signal can be output quickly.

In addition, in the foot switch 100 according to the comparative example, the position of a component deviating from a design value and the space between the pedal member 6 and the base unit 7 being opened are likely to arise as problems. In other words, the force (Fr) that the pedal member 6 receives from the rear wall portion 23 and the force (Fa) that the pedal member 6 receives from the rotating shaft portion 41 are large, and thus the parts that receive the forces are prone to elastic and plastic deformations. For example, it is assumed that the rear wall portion 23 is lowered by, for example, 0.2 mm by a downward reaction force attributable to "Fr". It is assumed that the design value of the distance of the front end portion of the pedal member 6 from the rotating shaft portion 41 is "Dt=85 mm". A deviation amount T of the position of the front end portion of the pedal member 6 becomes 1.7 mm by value substitution into Equation (4). In other words, it is understood that the front end portion of the pedal member 6 deviates by 1.7 mm to the upper side even in a case where the rotating shaft portion 41 is firmly made and does not move in the up-down direction. Actually, the rotating shaft portion 41 is also deformed. Accordingly, assuming that the rotating shaft portion 41 is moved by, for example, 0.2 mm by an upward reaction force (reaction force with respect to Fa), it is understood that the deviation amount of the front end portion of the pedal member 6 rises by 3.6 mm by value substitution into Equation (5). When the front end portion of the pedal member 6 rises, the space between the pedal member 6 and the base unit 7 is opened to result in problems such as a component in the foot switch 100 becoming visible and foreign matter entering.

$$T = 0.2 \times (Dt/Dr) \quad (4)$$

$$T = 1.7 + 0.2 \times (Dt + Dr)/Dr \quad (5)$$

Although the problems of the foot switch 100 according to the comparative example result from large forces acting on the pedal member 6, a similar problem arises in the event of a poor component precision. In other words, the rear wall portion 23 and the rotating shaft portion 41 being created without accuracy in terms of height results in the errors being magnified nearly 10 times and appearing as an error in the position of the front end portion of the pedal member 6. However, there is a problem that it is not easy to create a component with sufficient precision.

Next, the foot switch 1 according to the present embodiment will be described. In the foot switch 1 according to the present embodiment, the support portion 44 is designed such that the distance from the rotating shaft portion 41 is substantially equal to the spring 46 of the elastic force applying portion 42. The force balance of the pedal member 6 at a time when the pedal member 6 is not stepped on by a user will be described. First, it is assumed that the distance from the rotating shaft portion 41 to the spring 46 of the elastic force applying portion 42 is "Ds=39.3 mm". It is assumed that the three by which the pedal member 6 is pushed upward from the spring 46 is "Fs=2.0 kg". It is assumed that the distance from the rotating shaft portion 41 to the support portion 44 is "Dp=38.6 mm" Assuming that the force by which the pedal member 6 is pulled downward from the support portion 44 is "Fp" in this case, Equation (6) is established from the balance of the torque around the rotating shaft portion 41. Equation (7) is established as a result, and thus the result of "Fp=2.04 kg" can be obtained by value substitution into Equation (7). Since Fp is slightly larger than Fs, the force that acts on the through hole 16 from the rotating shaft portion 41 is upward and the magnitude of the force is as small as 0.04 kg.

$$Fs \times Ds = Fp \times Dp \quad (6)$$

$$Fp = (Fs \times Ds)/Dp \quad (7)$$

As described above, the maximum value of the force that acts on a component is approximately equal to the force that is generated by the spring 46, and thus the possibility of component destruction is low, a longer product service life can be achieved, and a change in shape can be suppressed.

In addition, only a small force acts on the support portion 44, and thus the deformation of the support portion 44 can also be suppressed to a low level. The force that acts on the rear wall portion 23, which is the support portion 144 of the foot switch 100 according to the comparative example, is "Fr=9.9 kg", and thus a deformation amount v of the support portion 44 is represented by Equation (8) and the result of "v=0.04 mm" can be Obtained by value substitution into Equation (8). It is assumed that the design value of the distance of the front end portion of the pedal member 6 from the rotating shaft portion 41 is "Dt=88 mm". The deviation amount T of the position of the front end portion of the pedal member 6 is only 0.09 mm by value substitution into Equation (9). The force that acts on the rotating shaft portion 41 is almost zero, and thus the amount of movement of the rotating shaft portion 41 is almost zero. As described above, in the foot switch 1 of the present embodiment, the amount of upward deviation of the front end portion of the pedal member 6 is only 0.09 mm and can be suppressed to a considerably small amount as compared with the amount of upward deviation of the front end portion of the pedal member 6 of the foot switch 100 according to the comparative example, which is 3.6 mm.

$$v=0.2\times(Fp/Fr) \tag{8}$$

$$T=0.04\times(Dt/Dp) \tag{9}$$

In addition, in the foot switch 1, the base unit 7 includes the base member 20 provided with the elastic force applying portion 42 and the switch portion 43 and the connecting members 30A and 30B connected to the end portions of the base member 20 in the width direction D2. The support portion 44 has the engaging portion 54 engaging with the side wall portions 14A and 14B of the pedal member 6 from the inside in the width direction D2, and the rotating shaft portion 41 and the engaging portion 54 are provided on the connecting members 30A and 30B. In this manner, the rotating shaft portion 41 and the engaging portion 54 are provided on the connecting members 30A and 30B, which are members separate from the base member 20. Accordingly, by attaching the connecting members 30A and 30B to the side wall portions 14A and 14B of the pedal member 6 from the inside in the width direction D2, it is possible to assemble a structure in which the rotating shaft portions 41 are connected to the side wall portions 14A and 14B of the pedal member 6 and the side wall portions 14A and 14B are engaged by the engaging portions 54.

A plurality of the switch units 2 including the pedal member 6 and the base unit 7 may be provided, and the connecting members 30 of the adjacent switch units 2 may be connected to each other via the connecting portion 31. In this case, the connecting member 30 can be diverted as a member for connecting the adjacent switch units 2.

In the foot switch 1, the base unit 7 may have the front wall portion 22 on the front side in the front-rear direction D1, the front wall portion 22 may have the abutting surface 60 abutting against the pedal member 6 in a state where the pedal member 6 is stepped on, and the abutting surface 60 may be inclined such that the distance from the pedal member 6 to the abutting surface 60 increases toward the outside in the width direction D2.

First, a comparative example will be described. For example, a case where the abutting surface 60 does not have the inclined portions 60*b* and 60*c*, which is illustrated in FIG. 4B, will be described. In a case where the pedal member 6 is tilted to the left side with respect to the base unit 7 when the pedal member 6 is stepped on by a user, the left end portion of the tilted pedal member 6 abuts near the left end portion of the abutting surface 60. As a result, the movement of the pedal member 6 is restricted and no further downward depression occurs. On the other hand, at the middle position of the pedal member 6, the pedal member 6 is in a state of floating from the abutting surface 60. In this case, the pedal member 6 is incapable of pressing the switch portion 43.

Figure 4A:
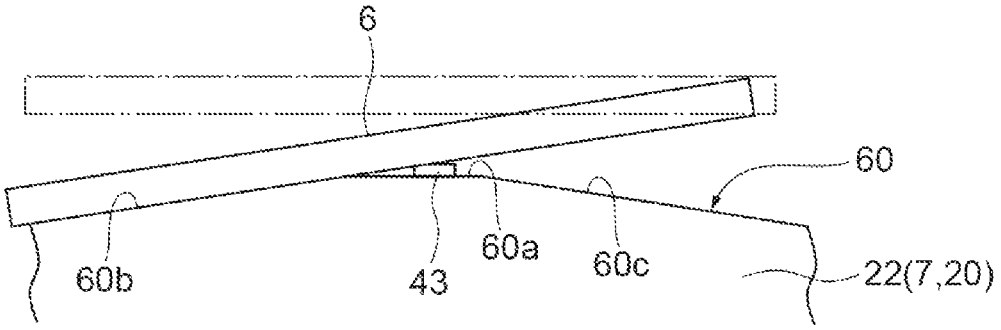
FIG. 4A is a schematic view in which the front wall portion of the base member of the foot switch according to the present embodiment is viewed from the front side.
Figure 4B:
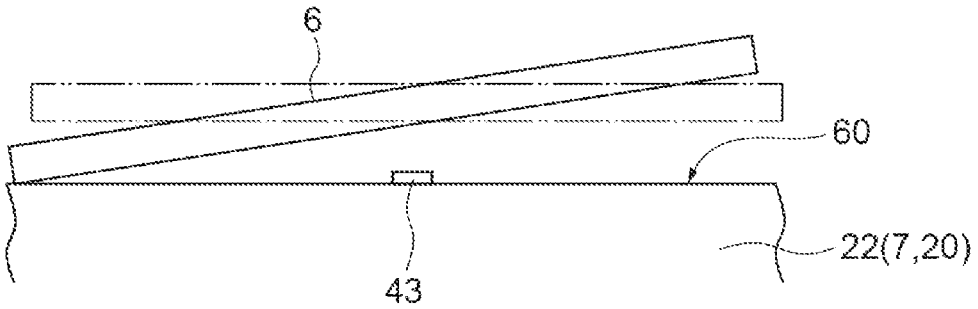
FIGS. 4B and 4C are schematic views in which the front wall portion of the base member of a foot switch according to a comparative example is viewed from the front side.
Figure 4C:
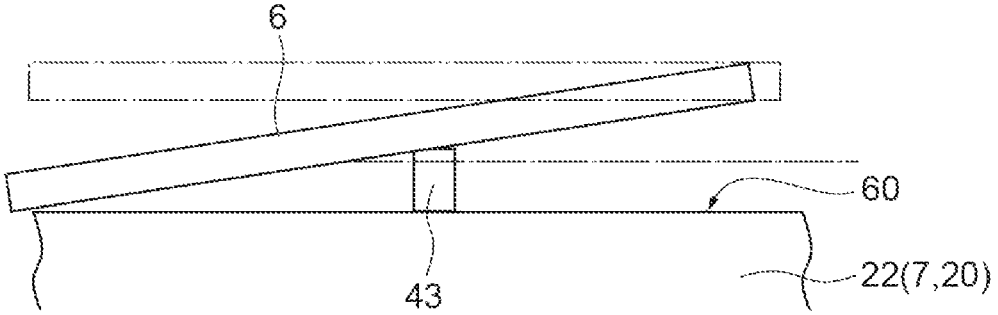

In order to solve the problem of the configuration of FIG. 4B, a configuration in which the entire abutting surface 60 is lowered may be adopted as illustrated in FIG. 4C. The one-dot chain line in FIG. 4C indicates the position of the abutting surface 60 in FIG. 4B. In a case where the pedal member 6 is tilted to the left side with respect to the base unit 7 when the pedal member 6 is stepped on by a user, the left end portion of the tilted pedal member 6 abuts near the left end portion of the abutting surface 60. At this time, the entire abutting surface 60 is lowered, and thus the middle position of the pedal member 6 can also be sufficiently lowered and the switch portion 43 can be pressed. However, in a case where the pedal member 6 is stepped on straight and without tilting, further downward depression is possible, even if the pedal member 6 is depressed to a position appropriate for the switch portion 43, as there is no stopper with respect to the pedal member 6. Accordingly, the switch portion 43 is pushed more than necessary and malfunction or the like may arise.

In the foot switch 1 according to the present embodiment illustrated in FIG. 4A, the inclined portions 60*b* and 60*c*, which are inclined parts of the abutting surface 60, are capable of accepting the tilting of the pedal member 6 in a case where the pedal member 6 is tilted with respect to the base unit 7 when the pedal member 6 is stepped on by a user. Accordingly, even in a case where the pedal member 6 is depressed in an inclined state, it is possible, unlike in the structure of FIG. 4B, to suppress the movement of the pedal member 6 being restricted by the abutting surface 60 before the operation of the switch portion 43. In a case where the pedal member 6 is depressed straight and without tilting, the top portion 60*a* at the middle position of the abutting surface 60 is disposed at an appropriate position, and thus further movement is restricted by the top portion 60*a* at an appropriate position when the pedal member 6 pushes the switch portion 43.

The present invention is not limited to the embodiment described above.

The configuration of the switch unit of the foot switch 1 may be appropriately changed within the gist of the present invention. For example, the positional relationship between the elastic force applying portion and the support portion in the front-rear direction is not limited to the embodiment described above and the distance of separation may be increased.

In addition, the switch unit count of the foot switch 1 may be one or three or more without being limited to two.

In the embodiment described above, one spring 46 as the elastic force applying portion 42 is disposed substantially in the middle of the main body portion 21 in the width direction D2. Alternatively, two springs having substantially the same elastic force may be disposed at bilaterally symmetrical positions.

The switch portion 43 in the embodiment described above is disposed on the rear side of the elastic force applying portion 42 of the main body portion 21. Alternatively, the switch portion 43 may be disposed on the front side of the elastic force applying portion 42 of the main body portion 21.

REFERENCE SIGNS LIST

1: foot switch, 6: pedal member, 7: base unit, 14A, 14B: side wall portion, 20: base member, 22: front wall portion, 30A, 30B: connecting member, 41: rotating shaft portion, 42: elastic force applying portion, 43: switch portion, 44: support portion, 54: engaging portion, 60: abutting surface.

What is claimed is:

1. A foot switch comprising:

a pedal member extending in a front-rear direction; and a base unit connected to the pedal member via a rotating shaft portion, wherein the base unit includes:

an elastic force applying portion applying an elastic force to the pedal member;

a switch portion operated by the pedal member by the pedal member being stepped on and rotating around the rotating shaft portion;

a support portion supporting the pedal member by applying a force to the pedal member in a direction opposite to the elastic force applied from the elastic force applying portion in a state where the pedal member is yet to be stepped on;

a base member provided with the elastic force applying portion and the switch portion; and a connecting member connected to an end portion of the base member in a width direction, the elastic force applying portion and the support portion are disposed on one side in the front-rear direction with respect to the rotating shaft portion, the support portion supports a side wall portion of the pedal member, the support portion has an engaging portion engaging with the side wall portion of the pedal member from an inside in the width direction, and the rotating shaft portion and the engaging portion are provided on the connecting member.

2. The foot switch according to claim 1, comprising adjacent switch units each including the pedal member and the base unit, wherein a respective connecting member of the adjacent switch units are connected to each other via a connecting portion.

3. The foot switch according to claim 1, wherein the base unit has a wall portion on one side in the front-rear direction, the wall portion has an abutting surface abutting against the pedal member in a state where the pedal member is stepped on, and the abutting surface is inclined such that a distance between the abutting surface and the pedal member increases when a position on the abutting surface goes from a center of the abutting surface to an outside in a width direction.

* * * * *